US007387554B1

(12) United States Patent
Behara et al.

(10) Patent No.: US 7,387,554 B1
(45) Date of Patent: Jun. 17, 2008

(54) DAMPING MECHANISM FOR A MARINE PROPELLER

(75) Inventors: John W. Behara, Stillwater, OK (US); Darrin L. Doty, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/488,359

(22) Filed: Jul. 18, 2006

(51) Int. Cl.
*B63H 23/34* (2006.01)
*B63H 5/125* (2006.01)

(52) U.S. Cl. ..... 440/83; 440/55

(58) Field of Classification Search ..... 440/83
See application file for complete search history.

(56) References Cited

U.S. PATENT DOCUMENTS 2,751,987 A * 6/1956 Kiekaefer ..... 416/169 R
3,871,324 A * 3/1975 Snyder ..... 440/55
4,223,773 A 9/1980 Croisant et al. ..... 192/48.91
5,006,084 A 4/1991 Handa ..... 440/75
6,659,911 B2 12/2003 Suzuki et al. ..... 477/109
6,799,946 B1 * 10/2004 Neisen ..... 416/134 R
6,884,131 B2 4/2005 Katayama et al. ..... 440/75
6,893,305 B2 5/2005 Natsume et al. ..... 440/75
6,942,530 B1 9/2005 Hall et al. ..... 440/1

* cited by examiner

*Primary Examiner*—Jesús D Sotelo
(74) *Attorney, Agent, or Firm*—William D. Lanyi

(57) ABSTRACT

A transmission for a marine propulsion device is provided with a movable member that responds to relative rotational movement between it and a driving shaft with an axial movement relative to the driving shaft and to a driven component. This axial movement is directed against one of two spring components which resist the axial movement. During the compression of either of the spring components, rotation of the driven component is non-synchronous with the driving component during a brief period of time. Also, the driven component is decoupled at least partially from torque transmitting relation with the driving component during the axial movement of the movable member relative to the driving and driven components.

22 Claims, 4 Drawing Sheets

DAMPING MECHANISM FOR A MARINE PROPELLER

BACKGROUND OF THE INVENTION

1. Field of the Invention

The present invention is generally related to a damping mechanism and, more particularly, to a mechanism which responds to changes in rotational speed of a propeller shaft and a propeller hub by temporarily decoupling, or partially decoupling, the propeller hub from the propeller shaft through relative axial movement of associated components.

2. Description of the Related Art

U.S. Pat. No. 4,223,773, which issued to Croisant et al. on Sep. 23, 1980, discloses a drive engaging apparatus. A clutch apparatus for a marine drive lower gear case includes a propeller shaft rotatably mounted in a gear case housing. A drive gear for both forward and reverse is positioned in the housing coaxial with the propeller shaft and a clutch member is rotatably fixed on the propeller shaft and movable axially into drive engagement with the drive gear. Clutch engaging elements are provided on opposite portions of the drive gears and the clutch member. Shift means utilizing a positive acting cam means positively move the clutch member into and out of engagement with the drive gears. The shift means also include a releasable latch means to positively maintain the shift means in the engaged position and a preloading means between the shift means and the clutch member to snap the clutch member into engagement.

U.S. Pat. No. 5,006,084, which issued to Handa on Apr. 9, 1991, describes a shift device for marine propulsion. A marine propulsion forward, neutral, reverse transmission incorporating a single spring for yieldably cushioning the shifting into either forward or reverse is described. Various embodiments of detent mechanisms and spring locations are illustrated as is an arrangement for providing a different spring loading in one direction from the opposite direction.

U.S. Pat. No. 6,659,911, which issued to Suzuki et al. on Dec. 9, 2003, describes a shift assist system for an outboard motor. The system regulates the torque of the engine to ensure proper effortless shifting. The system recognizes open circuit or short circuit faults and nevertheless enables the torque of the engine to be reduced to facilitate easy gear selection.

U.S. Pat. No. 6,884,131, which issued to Katayama et al. on Apr. 26, 2005, describes a shift mechanism for a marine propulsion unit. An outboard motor incorporates a driveshaft and a propulsion shaft driven by the driveshaft. The driveshaft carries a pinion. The propulsion shaft carries forward and reverse gears. The pinion always meshes with the forward and reverse gear and drives the forward and reverse gears in opposite directions relative to each other. A hydraulic forward clutch mechanism couples the forward gear with a propulsion shaft. A hydraulic reverse clutch mechanism couples the reverse gear with the propulsion shaft. A shift actuator selectively operates the forward clutch mechanism or the reverse clutch mechanism to provide forward, reverse and/or neutral running conditions for the outboard motor.

U.S. Pat. No. 6,893,305, which issued to Natsume et al. on May 17, 2005, describes a shift mechanism for a marine propulsion unit. The unit has a driveshaft and propulsion shaft driven by the driveshaft and driving a propeller. The driveshaft carries a pinion. The propulsion shaft carries forward and reverse gears. The pinion meshes with the forward and reverse gears. The pinion drives the forward and reverse gears in opposite directions relative to each other. A sleeve is rotatable with the propulsion shaft. The sleeve is slidably disposed between the forward and reverse gears on the propulsion shaft. The forward and reverse gears have teeth on a surface thereof that opposes the sleeve. The sleeve has recesses on each surface thereof that opposes the forward or reverse gear. Each tooth can enter a corresponding recess. The tooth has a length substantially the same as a length of the recess in a circumferential direction.

U.S. Pat. No. 6,942,530, which issued to Hall et al. on Sep. 13, 2005, discloses an engine control strategy for a marine propulsion system for improving shifting. An engine control strategy selects a desired idle speed for use during a shift event based on both speed and engine temperature. In order to change the engine operating speed to the desired idle speed during the shift event, ignition timing is altered and the status of an idle air control valve is changed. Theses changes to the ignition timing and idle air control valve are made in order to achieve the desired engine idle speed during the shift event. The idle speed during the shift event is selected so that the impact shock and resulting noise of the shift event can be decreased without causing the engine to stall.

The patents described above are hereby expressly incorporated by reference in the description of the present invention.

SUMMARY OF THE INVENTION

A transmission for a marine propulsion device made in accordance with a preferred embodiment of the present invention comprises a driving component, such as a driveshaft connected in torque transmitting relation with an engine, a driven component, such as a propeller hub, a movable member coupled to the driving and driven components, and a resilient member configured to urge the movable member toward a preselected position, whereby relative rotation between the driving and driven components causes the movable member to move away from the preselected position.

In a particularly preferred embodiment of the present invention, relative rotation between the driving and driven components in a first rotational direction causes the movable member to move axially in a first direction relative to the driving and driven components. Relative rotation between the driving and driven components in a second rotational direction causes the movable member to move axially in a second direction relative to the driving and driven components. The first and second axial directions are opposite to each other in a preferred embodiment of the present invention. The resilient member can comprise a first spring and a second spring. The first spring is configured to resist movement of the movable member in the first axial direction and the second spring is configured to resist movement of the movable member in a second axial direction. The first and second springs can comprise Belleville washers.

In a preferred embodiment of the present invention, the driven component is at least partially decoupled from torque transmitting relation with the driving component when the movable member is moving axially relative to the driving and driven components. The transmission in a preferred embodiment of the present invention can further comprise a first set of splines formed in an outer surface of the movable member and a second set of splines formed in an inner surface of the movable member. The first set of splines can comprise a plurality of straight splines which are generally parallel to an axis of rotation of the movable member. The second set of splines can comprise a plurality of helical splines. The present invention can further comprise first and second spacers disposed between the movable member and the first and second springs, respectively.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
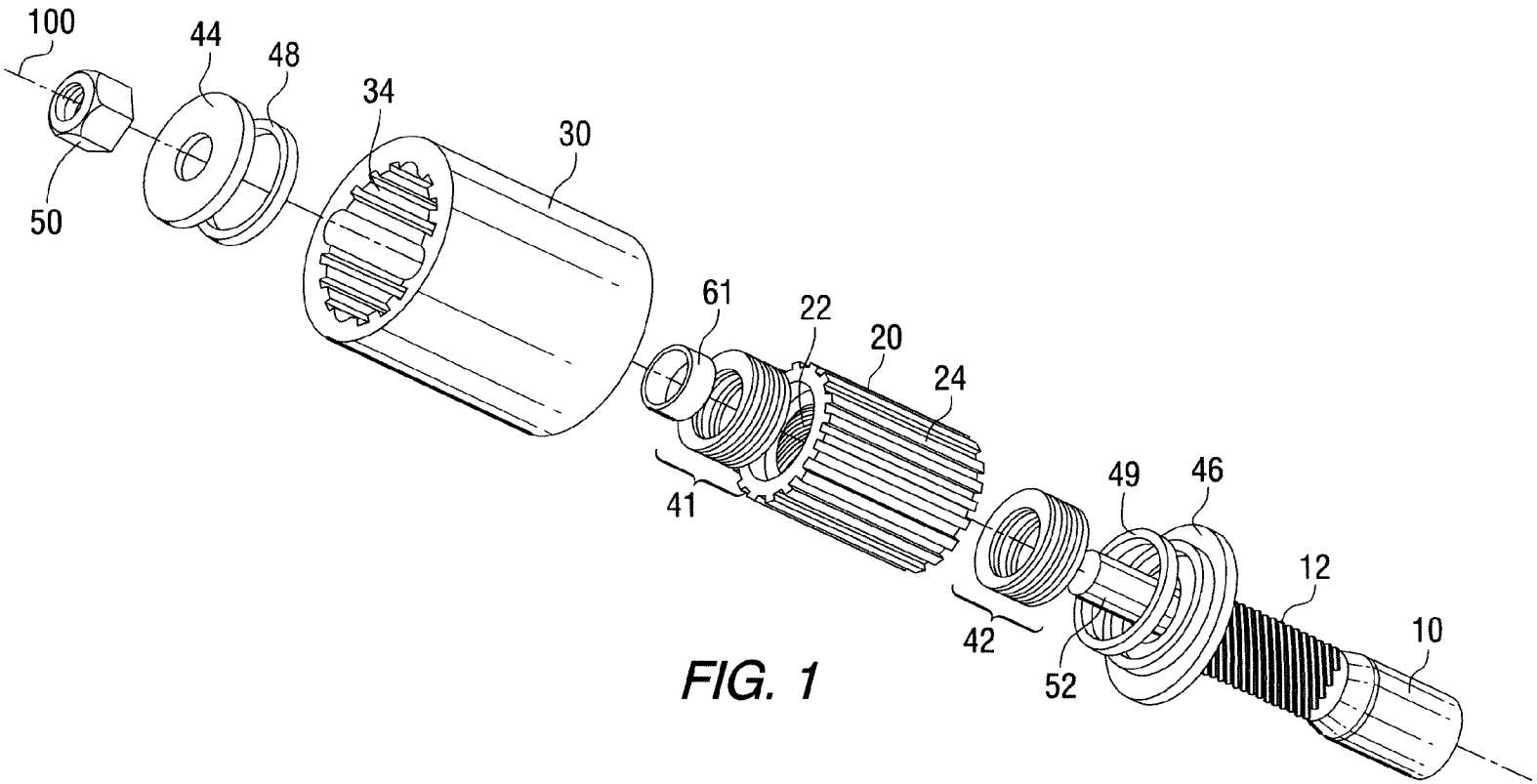
FIG. 1 is an isometric exploded view of one embodiment of the present invention.

Throughout the description of the preferred embodiment of the present invention, like components will be identified by like reference numerals.

FIG. 1 is an exploded isometric view of one embodiment of the present invention. A driving component 10, such as a driveshaft or propeller shaft of a marine propulsion device, is provided with a plurality of helical splines 12. A movable member 20 is provided with a plurality of internally formed helical splines 22 which are engaged with the external helical splines 12 of the driving component 10. The movable member 20 is also provided with externally formed splines 24 which are formed in its outer cylindrical surface. A driven component 30, such as the propeller hub shown in FIG. 1, is provided with internally formed splines 34 that are shaped to be engaged with the splines 24 of the movable member 20. In FIG. 1, splines 24 and 34 are straight splines.

With continued reference to FIG. 1, a resilient member is configured to urge the movable member 20 toward a preselected position. The resilient member, in a preferred embodiment of the present invention, comprises a first spring 41 and a second spring 42. In a particularly preferred embodiment of the present invention, the first and second springs each comprise a plurality of Belleville washers.

With continued reference to FIG. 1, washers 44 and 46 are combined with dampers, 48 and 49, to contain the assembly of components in position relative to each other. A nut 50 is threadable onto a threaded end 52 of the driveshaft, or driving component 10. Two spacers are also used in a preferred embodiment of the present invention. One of the two spacers 61 is illustrated in FIG. 1. During testing of one embodiment of the present invention, it was discovered that performance is enhanced if the nut 50 is tightened on the threads of the propeller shaft to a sufficient magnitude that axial force is exerted between washers 44 and 46. While this tightening of nut 50 may not achieve enhanced performance in all embodiments of the present invention, empirical improvement was observed in at least one embodiment.

Figure 2:
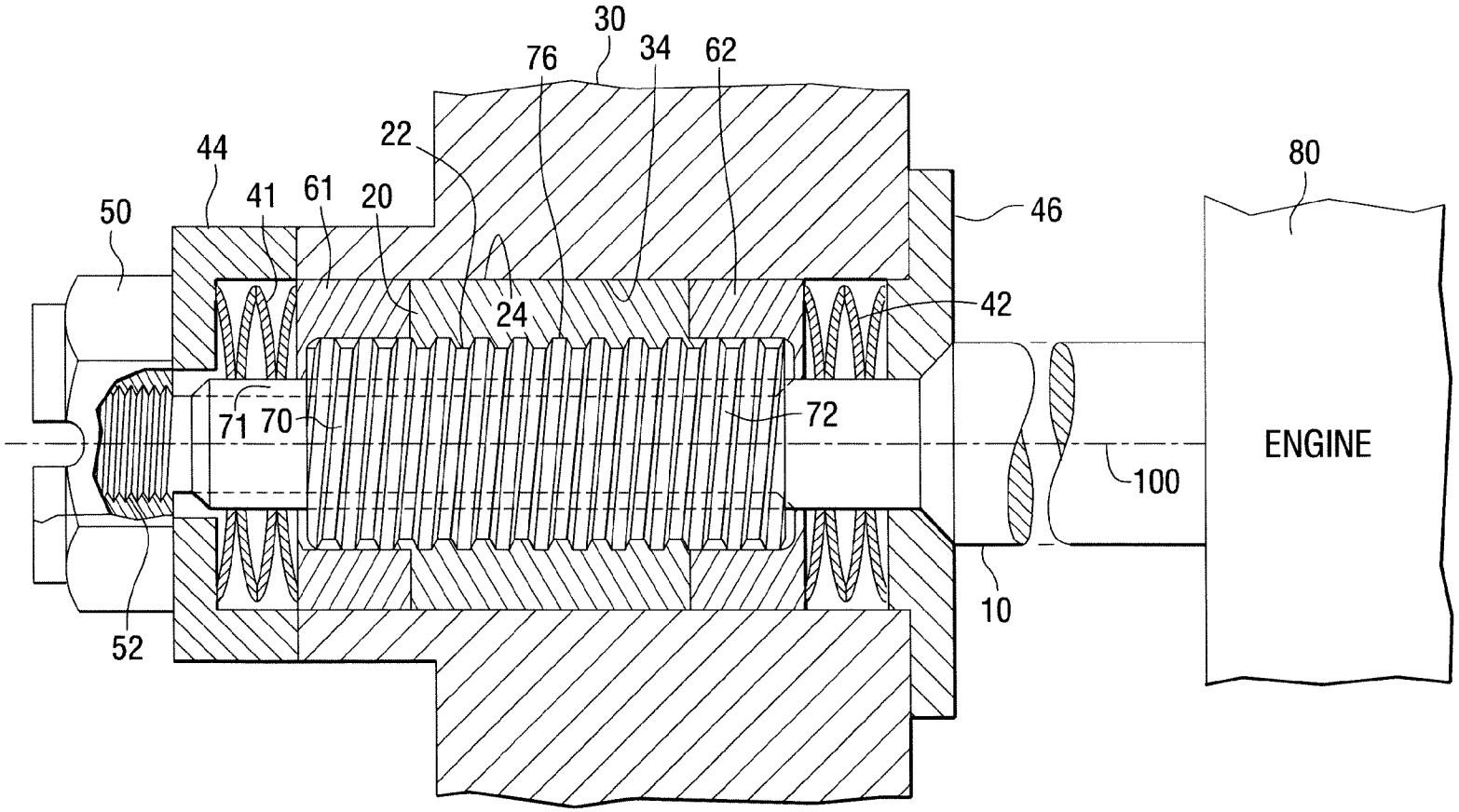
FIG. 2 is a side section view of one embodiment of the present invention.

FIG. 2 is a section view of the damping mechanism of the present invention. The embodiment illustrated in FIG. 2 also comprises an adapter 70 which allows the other components shown in FIG. 2 to be used in conjunction with a driving component 10, or propeller shaft, which does not have the helical splines 12 formed in it as described above in conjunction with FIG. 1. The adapter 70 is provided with internal straight splines that are coupled with straight splines 71 that are normally provided in propeller shafts. This allows the adapter 70 to provide a spline connection, at the region identified by reference numeral 72, with a propeller shaft 10. Although not necessary in all embodiments of the present invention, this type of straight spline connection between the propeller shaft 10 and the adapter 70, at region 72, allows standard propeller shafts to be retrofitted for use in conjunction with the present invention. The outer surface of the adapter 70 is provided with helical splines 76 which are generally similar to the helical splines 12 described above in conjunction with FIG. 1. These helical splines are shaped to be coupled to internally formed helical splines 22 of the movable member 20. As described above, the movable member 20 is provided with externally formed straight splines 24.

With continued reference to FIG. 2, the first and second spacers, 61 and 62, are shown with the movable member 20 therebetween. In addition, the first and second springs, 41 and 42, are formed by a plurality of Belleville washers.

With continued reference to FIGS. 1 and 2, it can be seen that the movable member 20 and the driven component 30 are coupled by the straight spline interconnection to rotate synchronously with each other. In addition, the movable member 20 is rotatable relative to the adapter 70 in FIG. 2 and to the driving component 10, such as the propeller shaft.

With continued reference to FIGS. 1 and 2, it should be noted that relative rotational movement between the outer helical splines 76 of the adapter 70 and the inner helical splines 22 of the movable member 20 will cause axial movement of the movable member 20 if the adapter 70 is axially stationary. The axial movement of the movable member 20 will cause one of the spacers, 61 or 62, to move axially with the movable member 20 and compress one of the two springs, 41 or 42, depending on the axial direction of movement of the movable member 20. That compressed spring will resist the axial movement of the movable member 20 momentarily and then urge the movable member 20 back to a central position such as the position illustrated in FIG. 2. When the propeller shaft is shifted into either forward or reverse gear, the propeller shaft will instantaneously begin to rotate at a speed which is faster than the propeller hub 30 because of the natural inertia of the propeller hub. During this initial rotation of the propeller shaft, the interaction of the helical splines, 76 and 22, in combination with the action of the first and second springs, 41 and 42, will allow relative rotation and resulting axial movement between the propeller shaft 10 and the propeller hub 30. As a result, the impact on the overall power train is reduced along with the resulting noise that can be caused by this impact.

In FIG. 2, it should be understood that a clutch mechanism is typically located between the engine 80 and the rest of the mechanism illustrated in the figure. That clutch mechanism typically comprises a dog clutch component which moves axially between a first position of engagement with a forward gear and a second position of engagement with a reverse gear. The connection and disconnection of the dog clutch with the forward and reverse gears results in sudden accelerations and decelerations of the propeller itself. The operation of the dog clutch is described in significant detail in U.S. Pat. No. 4,223,773 and is very well known to those skilled in the art of marine transmissions.

With continued reference to FIG. 2, it should be understood that the external splines 76 which rotate in synchrony with the propeller shaft can be formed as part of the propeller shaft. The adapter 70 is illustrated in FIG. 2 to show the alternative embodiment in which a standard propeller shaft, with straight splines 71, can be adapted to provide helical splines 76 through the use of an adapter 70. In addition, with reference to FIGS. 1 and 2, it should be understood that the helical splines can be provided either on the inside surface of the movable member 20 or the outside surface. Furthermore, the interface between the movable member 20 and the driven component 30, such as a propeller hub, can be an interface other than a splined interface. In other words, the axial movement can be provided by the relative axial movement between the adapter 70 and the propeller shaft in combination with the relative rotational movement of the adapter 70 and the movable member 20.

Figure 3:
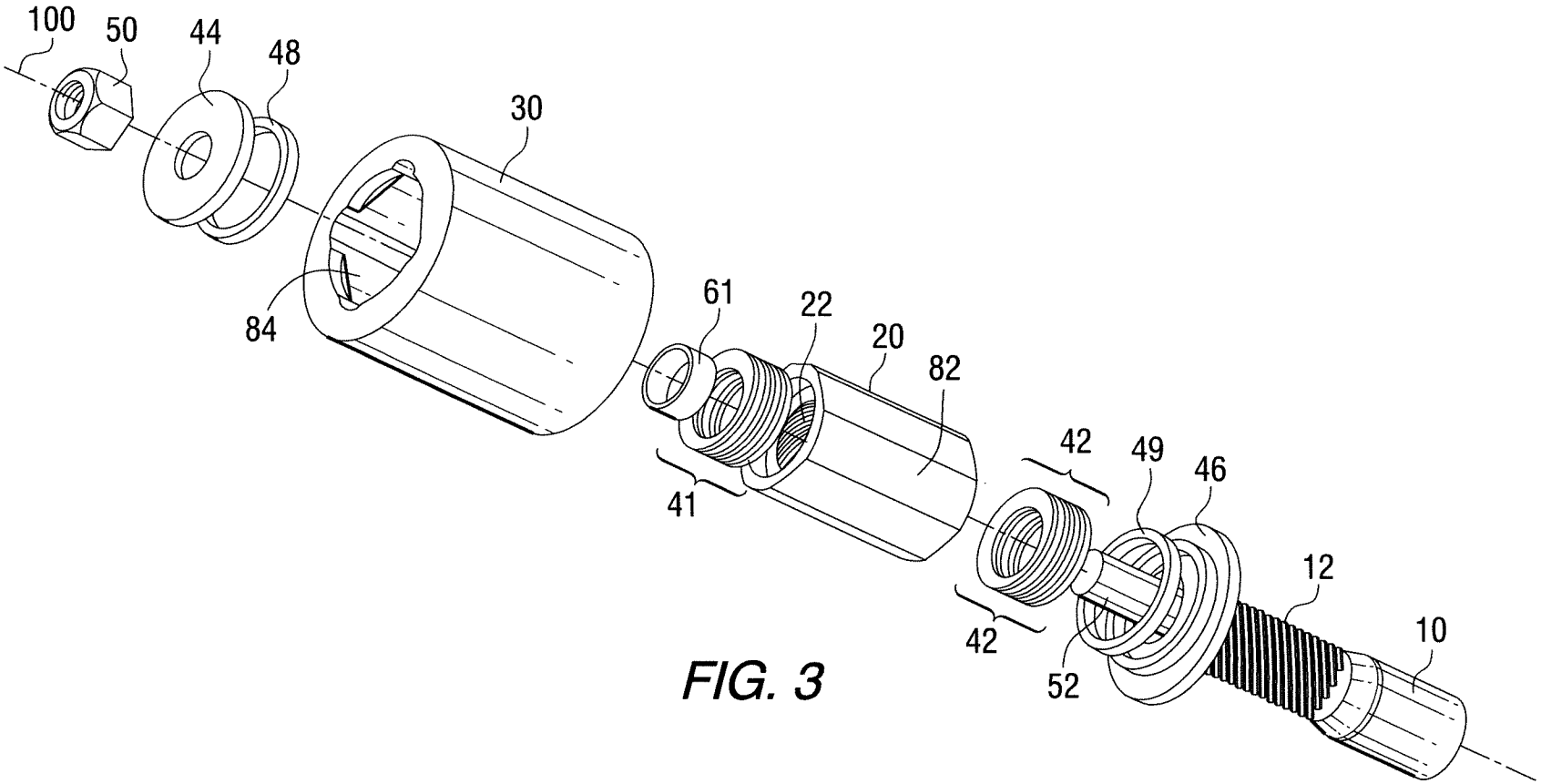
FIG. 3 is an exploded isometric view of an alternative embodiment of the present invention.

FIG. 3 shows an alternate embodiment of the present invention. It is generally similar to the exploded isometric view in FIG. 1, but with different configurations on the outer surface of the movable member 20 and the inner surface of the driven component 30. On the outer surface of the movable member 20, a plurality of flat segments 82 are provided and shaped to be received in sliding contact with a plurality of flat surfaces 84 on the inside of the driven component 30. These flat surfaces serve the same purpose as the straight splines, 24 and 34, illustrated in FIG. 1 and located on the outer surface of the movable member 20 and the inner surface of the driven component 30. In both cases, the movable member 20 is configured to slide axially relative to the driven component 30 in response to relative rotation between the movable member 20 and the driving component 10, such as a propeller shaft.

Figure 4:
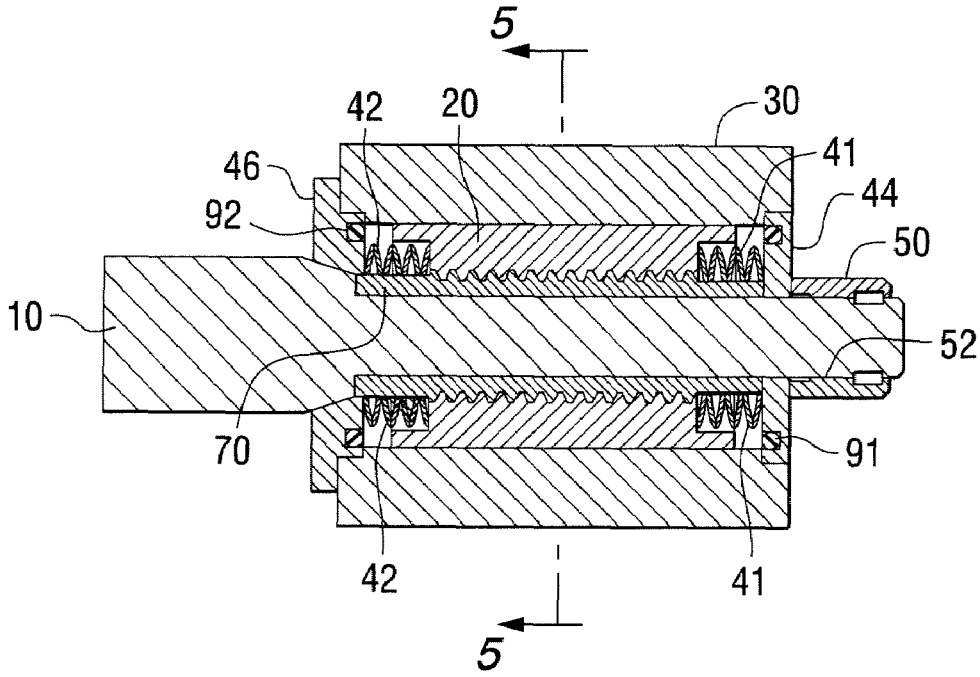
FIG. 4 is a side section view of an alternative view of the present invention.

FIG. 4 is a side view of an alternative embodiment of the present invention in which the movable member 20 is not provided with additional spacers, such as those identified by reference numerals 61 and 62 in the above description, and the adapter 70 is provided with internal straight splines which mesh with external straight splines of the propeller shaft 10. In addition, second stage dampers, which are identified by reference numerals 91 and 92 in FIG. 4, are provided.

With continued reference to FIG. 4, it can be seen that the nut 50 rigidly holds the driven component 30 and its washers, 44 and 46, to the propeller shaft 10. The movable member 20 is allowed to move axially between the washers, 44 and 46, as it compresses the spring, 41 or 42, as a result of this axial movement. In addition, the movable member 20 illustrated in FIG. 4 is rotatable relative to the adapter 70 when the propeller shaft 10 accelerates in one rotational direction or the other. During that period of acceleration when the propeller shaft 10 is rotating at a speed faster than the driven component 30, the axial movement of the movable member 20 provides a delay during which the driven component 30 can increase its rotational speed under the urging of the springs, 41 or 42, and the resultant impact on the drive train is significantly decreased.

Figure 5:
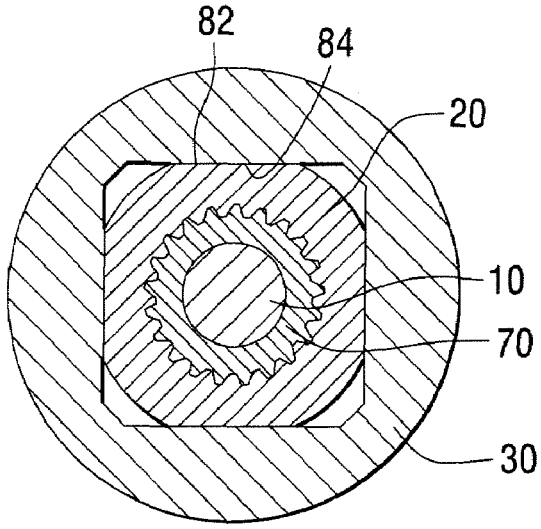
FIG. 5 is a section view of FIG. 4.

FIG. 5 is a section view of FIG. 4 as shown. As illustrated, the interface between the outer surface of the adapter 70 and the inner surface of the driven component 30 comprises a plurality of flat segments. These are the flat surfaces identified by reference numerals 82 and 84 and described above in conjunction with FIG. 3. They allow the movable member 20 to slide axially relative to the driven component 30. The embodiment shown in FIGS. 4 and 5 incorporate the concept of providing the adapter 70 between the propeller shaft 10 and the movable member 20 so that a conventional propeller shaft 10, with straight splines formed therein, can be used in conjunction with a movable member 20 that has helical splines formed in its inner surface. The adapter 70 provides a transition between the straight splines of the propeller shaft and the helical splines inside the movable member 20. Also, the embodiment shown in FIGS. 4 and 5 incorporates the concept of using flat outer surfaces on the movable member 20 rather than the straight splines 24 described above in conjunction with FIG. 1 which are shaped to mesh with straight splines 34 inside the driven component 30.

With reference to FIGS. 1-5, it can be seen that a transmission for a marine propulsion device in a preferred embodiment of the present invention comprises a driving component 10, such as a propeller shaft, a driven component 30, such as a propeller hub, a movable member 20 which is coupled to both the driving and driven components, 10 and 30, and a resilient member which is configured to urge the movable member 20 toward a preselected position. The resilient member can comprise Belleville washers, 41 and 42, as illustrated in the figures and described above. Relative rotation between the driving and driven components, 10 and 30, causes the movable member 20 to move away from the preselected position, such as the central position illustrated in FIG. 2. More specifically, relative rotation between the driving and driven components in a first rotational direction causes the movable member 20 to move axially in a first direction relative to the driving and driven components and relative rotation between the driving and driven components in a second, and opposite, direction causes the movable member 20 to move axially in a second direction relative to the driving and driven components. The first axial direction and the second axial direction are opposite to each other. The first spring 41 is configured to resist movement of the movable member in a first direction, such as toward the distal end 52 of the propeller shaft, and the second spring 42 is configured to resist movement of the movable member in the second direction, such as away from the nut 50. In a preferred embodiment of the present invention, the first and second springs, 41 and 42, are Belleville washers. The driven component 30 is at least partially decoupled from torque transmitting relation with the driving component 10 when the movable member 20 is moving axially relative to the driving and driven components. In other words, this decoupling occurs when relative rotational movement between the driven component 30 and the driving component 10 exists. This relative rotational movement is caused by the sudden acceleration of the propeller shaft in one direction and the inertia of the propeller which urges it to remain stationary during this period of time. It should be understood that this decoupling of the torque transmitting relationship is partial and occurs as the first or second spring is being compressed by the relative axial movement of the movable member 20.

With continued reference to FIGS. 1-5, in a preferred embodiment of the present invention a first set of splines 24 are formed in the outer surface of the movable member 20 and a second set of splines 22 are formed in the inner surface of the movable member 20. As illustrated in FIG. 1, the first set of splines 24 comprises a plurality of straight splines which are generally parallel to the axis 100 of rotation of the movable member 20. The second set of splines 22 comprises a plurality of helical splines as described above. The present invention, in a particularly preferred embodiment, can further comprise first and second spacers, 61 and 62, disposed between the movable member 20 and the first and second springs, 41 and 42, respectively. In a particularly preferred embodiment of the present invention, the driven component 30 is a propeller hub in a marine propulsion system.

Although the present invention has been described in particular detail and illustrated with specificity to show several embodiments, it should be understood that alternative embodiments are also within its scope.

We claim:

1. A transmission for a marine propulsion device, comprising:

a driving component;

a driven component;

a movable member coupled to said driving and driven components; and a resilient member configured to urge said movable member toward a preselected position, whereby relative rotation between said driving and driven components causes said movable member to move away from said preselected position, relative rotation between said driving and driven components in a first rotational direction causes said movable member to move axially in a first direction relative to said driving and driven components and relative rotation between said driving and driven components in a second rotational direction causes said movable member to move axially in a second direction relative to said driving and driven components.

2. The transmission of claim 1, wherein:

said resilient member comprises a first spring and a second spring, said first spring being configured to resist movement of said movable member in said first direction, said second spring being configured to resist movement of said movable member in said second direction.

3. The transmission of claim 2, wherein:

said first and second springs comprise Belleville washers.

4. The transmission of claim 2, further comprising:

first and second spacers disposed between said movable member and said first and second springs, respectively.

5. The transmission of claim 1, wherein:

said driven component is at least partially decoupled from torque transmitting relation with said driving component when said movable member is moving axially relative to said driving and driven components.

6. The transmission of claim 1, further comprising:

a first set of splines formed in an outer surface of said movable member; and a second set of splines formed in an inner surface of said movable member.

7. The transmission of claim 6, wherein:

said first set of splines comprises a plurality of straight splines which are generally parallel to an axis of rotation of said movable member.

8. The transmission of claim 6, wherein:

said second set of splines comprises a plurality of helical splines.

9. The transmission of claim 1, wherein:

said driven component is a propeller.

10. The transmission of claim 1, further comprising:

a first set of splines formed in an outer surface of said movable member, said first set of splines comprising a plurality of flat surfaces configured to permit said movable member to move axially relative to said driven component; and a second set of splines formed in an inner surface of said movable member.

11. A transmission for a marine propulsion device, comprising:

a driveshaft which is connectable in torque transmitting relation with an engine;

a driven component;

a movable member coupled to said driveshaft and driven component, said movable member having a first set of splines formed in an outer surface of said movable member which are engaged with splines formed in said driven component and a second set of splines formed in an inner surface of said movable member which are engaged with splines formed in said driveshaft; and a resilient member configured to urge said movable member toward a preselected position, whereby relative rotation between said driveshaft and driven component causes said movable member to move away from said preselected position, whereby relative rotation between said driveshaft and driven component in a first rotational direction causes said movable member to move axially in a first direction relative to said driveshaft and driven component and relative rotation between said driveshaft and driven component in a second rotational direction causes said movable member to move axially in a second direction relative to said driveshaft and driven component.

12. The transmission of claim 11, wherein:

said resilient member comprises a first spring and a second spring, said first spring being configured to resist movement of said movable member in said first direction, said second spring being configured to resist movement of said movable member in said second direction.

13. The transmission of claim 12, wherein:

said first and second springs comprise Belleville washers.

14. The transmission of claim 12, wherein:

said driven component is at least partially decoupled from torque transmitting relation with said driveshaft when said movable member is moving axially relative to said driving and driven components.

15. The transmission of claim 14, wherein:

said first set of splines comprises a plurality of straight splines which are generally parallel to an axis of rotation of said movable member, said second set of splines comprising a plurality of helical splines.

16. The transmission of claim 15, further comprising:

first and second spacers disposed between said movable member and said first and second springs, respectively.

17. The transmission of claim 16, wherein:

said driven component is a propeller.

18. The transmission of claim 11, further comprising:

a first set of splines formed in an outer surface of said movable member, said first set of splines comprising a plurality of flat surfaces configured to permit said movable member to move axially relative to said driven component; and a second set of splines formed in an inner surface of said movable member.

19. A transmission for a marine propulsion device, comprising:

a driveshaft;

a driven component;

a movable member coupled to said driveshaft and driven component;

a first set of splines formed in an outer surface of said movable member; and a second set of splines formed in an inner surface of said movable member.

20. The transmission of claim 19, further comprising:

a resilient member comprising a first spring and a second spring, said first spring being configured to resist movement of said movable member in said first direction, said second spring being configured to resist movement of said movable member in said second direction, said resilient member being configured to urge said movable member toward a preselected position, whereby relative rotation between said driveshaft and driven component causes said movable member to move away from said preselected position, wherein relative rotation between said driveshaft and driven component in a first rotational direction causes said movable member to move axially in a first direction relative to said driveshaft and driven component and relative rotation between said driveshaft and driven component in a second rotational direction causes said movable member to move axially in a second direction relative to said driveshaft and driven component, said driven component being at least partially decoupled from torque transmitting relation with said driveshaft when said movable member is moving axially relative to said driveshaft and driven component.

21. The transmission of claim 20, further comprising:

first and second spacers disposed between said movable member and said first and second springs, respectively, said first and second springs comprising Belleville washers, said first set of splines comprising a plurality of straight splines which are generally parallel to an axis of rotation of said movable member, said second set of splines comprising a plurality of helical splines, said driven component being a propeller.

22. The transmission of claim 19, further comprising:

a first set of splines formed in an outer surface of said movable member, said first set of splines comprising a plurality of flat surfaces configured to permit said movable member to move axially relative to said driven component; and a second set of splines formed in an inner surface of said movable member.

* * * * *